US005360976A

United States Patent [19]

Young et al.

[11] Patent Number: 5,360,976

[45] Date of Patent: Nov. 1, 1994

[54] TIME OF FLIGHT MASS SPECTROMETER, ION SOURCE, AND METHODS OF PREPARING A SAMPLE FOR MASS ANALYSIS AND OF MASS ANALYZING A SAMPLE

[75] Inventors: David T. Young; Jill A. Marshall, both of San Antonio; Emile A. Schweikert, Bryan, all of Tex.; Melvin A. Park, Alexandria, Va.

[73] Assignee: Southwest Research Institute, San Antonio, Tex.

[21] Appl. No.: 935,039

[22] Filed: Aug. 25, 1992

[51] Int. Cl.[5] ..... H01J 49/04

[52] U.S. Cl. ..... 250/287; 250/281; 250/288

[58] Field of Search ..... 250/287, 288, 288 A, 250/281, 282, 423 R

[56] References Cited

U.S. PATENT DOCUMENTS

| | | | |
|---|---|---|---|
| 4,439,679 | 3/1984 | McIlroy et al. | 250/288 |
| 4,490,610 | 12/1984 | Ulbricht, Jr. | 250/287 |
| 4,694,168 | 9/1987 | Le Beyec et al. | 250/287 |
| 4,843,243 | 6/1989 | Biemann et al. | 250/288 |
| 4,920,264 | 4/1990 | Becker | 250/288 |
| 5,160,841 | 11/1992 | Chapman et al. | 250/288 |

OTHER PUBLICATIONS

R. D. MacFarlane and D. F. Torgerson, "$^{252}$Cf–Plasma Desorption Time-Of-Flight Mass Spectrometry," *Intern. J. Mass Spectrom. Ion. Phys.*, vol. 21, pp. 81–92 (1976).

R. D. MacFarlane and D. F. Torgerson, "Californium-252 Plasma Desorption Mass Spectroscopy,"0 *Science*, vol. 191, pp. 920–925 (5 Mar. 1976).

*Primary Examiner*—Paul M. Dzierzynski
*Assistant Examiner*—Kiet T. Nguyen
*Attorney, Agent, or Firm*—Gambrell, Wilson & Hamilton

[57] ABSTRACT

A portable time of flight mass spectrometer using plasma desorption sample ionization. The sample is deposited onto a sample surface by condensing a sample gas stream onto the surface. While the instrument is evacuated, the sample surface is cooled and a sample gas stream is injected into the instrument near the sample surface causing a portion of the gas stream to condense on the sample surface and the remainder to be removed by the evacuation pump. A mass spectrometer having a linear geometry is disclosed. A reflective geometry is also disclosed wherein the flight path length is maximized by placing the fission source between the sample surface and a single detector. A collector surface for receiving start signal-generating fission fragments is sized to insure equal collection of start signal fragments and sample ionizing fragments. An area on the sample surface which is occluded by the fission source is compensated for by appropriate sizing of the fission source and the collector surface.

29 Claims, 5 Drawing Sheets

TIME OF FLIGHT MASS SPECTROMETER, ION SOURCE, AND METHODS OF PREPARING A SAMPLE FOR MASS ANALYSIS AND OF MASS ANALYZING A SAMPLE

FIELD OF THE INVENTION

The present invention relates to mass spectrometers, to ion sources, to methods of preparing samples for mass analysis and to methods of mass analysis. More particularly, the invention relates to plasma desorption time of flight mass spectrometers, especially portable spectrometers, sample ionizers for such instruments, and methods of preparing samples for plasma desorption ionization and of mass analysis.

BACKGROUND OF THE INVENTION

Mass spectrometry is an analytical technique in which molecules of a sample are ionized in a vacuum and separated according to their mass charge ratio (m/Q, wherein m is the mass in amu and Q is the charge in units of electron charge). The number of ions having the same mass charge ratio within the resolution capacity of the equipment are counted and are typically reported as a peak on a mass spectrum having a horizontal position which corresponds to the m/e of the ions and a height which corresponds to the quantity of ions.

When a molecule of sample is ionized, it tends to break apart and produce a collection of ions which is characteristic of the parent molecular structure. Mass spectrometers with sufficient resolution capable of resolving and counting each ion. The resulting spectrum is effectively a fingerprint of the sample. High resolution mass spectrometers are further capable of determining the composition of a sample by resolving the mass to charge ratio of the parent ion so precisely that it can be distinguished from all other possible parent species.

The most common type of mass spectrometer resolves ions of different m/e by accelerating them to the same kinetic energy and then passing them through a magnetic field. In these magnetic instruments, resolution varies directly with the size of the magnet. Even moderate resolution devices are cumbersome, delicate and expensive. Accordingly, moderate and high resolution magnetic instruments have been largely confined to laboratory applications.

Another method of resolving ions by mass per charge is known as time of flight mass spectrometry (TOFMS). In a TOF mass spectrometer, the ions are accelerated to the same kinetic energy, allowed to traverse a flight path through a defined region and picked up by a detector at the other end of the flight region. TOFMS takes advantage of the fact that ions of different masses and equal initial energy that have been accelerated to the same kinetic energy travel at different velocities, as expressed in the equation $E_K = QV = \frac{1}{2}Mv^2$, wherein V is the acceleration voltage, $E_K$ is the ion's kinetic energy; Q is its charge in units of e ($1.6 \times 10^{-19}$ coul.); M is its mass; and v is its velocity. TOF mass spectrometers resolve ions by the time it takes them to traverse the flight region. Accordingly, TOF mass spectrometers do not require a magnet or the precise magnetic field variation control circuitry of magnetic instruments. This makes size reduction of TOF instruments for field use potentially more feasible than size reduction of magnetic instruments. Unfortunately, the resolution of TOF instruments is critically dependent upon accurate and precise time of flight detection and the reduction in flight times resulting from a shortened flight path has seriously limited the resolution presently attainable with compact instruments.

For accurate time of flight measurement, an instrument having a 20 cm flight region must be provided with a means to initialize a time measurement within nanoseconds of the moment of sample ionization. Second, the sample must be highly planar and normal to the flight path. And third, the detector must have good time resolution capability, i.e. a sufficiently fast rise time to detect ion impacts. Electronics and detector must recover sufficiently fast to record subsequent impacts. The effects of nonideal timing and sample alignment can be mitigated by lengthening the flight path, but at the expense of portability.

For the flight time measurement of an instrument to be precise as well as accurate, i.e. such that ions having the same m/e arrive at the detector simultaneously, the kinetic energy imparted by acceleration must be much greater than the statistically random thermal energy of the ions prior to acceleration and the flight region must be shielded from the effects of stray magnetic and nonuniform electric fields which distort the flight path of the ions.

The accuracy of time measurement in a compact instrument can be improved up to a point by improving the time resolution capability of the electronics. Suitable commercial time to digital converters may be utilized in the present invention. Preferably, a highly accurate digital convertor is utilized, such as that disclosed in commonly assigned co-pending application Ser. No. 07/493,507, filed Mar. 14, 1990, hereby incorporated by reference, which improves time resolution by a factor of ten or more over convertors previously employed with TOF instruments. Thus, the flight region of an instrument can, in theory, be reduced by a factor of ten while maintaining the same accuracy.

Though improved time measurement capability has made construction of portable moderate and high resolution mass spectrometers potentially more feasible than previously thought, obstacles to the construction and operation of portable instruments remain.

In their article entitled "$^{252}$Cf-Plasma Desorption Time-Of-Flight Mass Spectrometry," *Intern. J. Mass Spectrom. Ion. Phys.*, Vol. 21, pp. 81–92 (1976), Macfarlane and Torgerson describe a promising combination of a time of flight mass analyzer with a plasma desorption ionizer. In the plasma desorption ionizer, the sample to be mass analyzed is adsorbed onto a surface and bombarded with fission fragments from a radioactive source, $^{252}$Cf. The interaction of fission fragments with the sample ejects and ionizes sample molecules whereupon they are available for acceleration and mass analysis. Unlike more common ionization methods such as electron ionization and chemical ionization, the sample molecules are volatilized and ionized simultaneously.

The $^{252}$Cf nucleus fissions into two fragments which travel in nearly opposite directions. Thus each fission fragment which strikes a sample to induce desorption has a complementary fragment which can be detected and used to generate a start signal for time-of-flight measurement.

Though otherwise ideally suited for ionizing sample in a portable instrument, $^{252}$Cf poses a potential health risk to the instrument operator and Federal regulations restrict its transportation in potentially hazardous quantities. Reducing the size of a $^{252}Cf$ source is one way to reduce the safety hazard posed by the instrument. But reducing the size of the fission source likewise diminishes the rate at which fission events occur, which must be compensated by improvements in efficiency. Efficiency can be improved by increasing the probability that a given fission event will produce sample ions. This probability is enhanced when the sample is deposited in a homogeneous thin layer over the entire sample foil. MacFarlane and Torgerson observed that a homogeneous layer of sample could be formed on the sample foil using an electrospray technique. However, to electrospray a sample onto the surface of a sample foil, or other surface, the instrument must be opened to provide access. This requires evacuation of the instrument as each new sample is introduced. In addition, opening the instrument can increase the operator's exposure to harmful amounts of radiation, and reduce the useful lifetime of the detector by exposure to potential chemical contaminants.

It would therefore be highly desirable to deposit a homogenous layer of sample onto a surface where it can be subjected to ionizing radiation without the need for opening the instrument and re-evacuating it with the introduction of each new sample.

Plasma desorption is a gentle ionization method which typically produces only a few types of fragments of which the parent (M+1) ion is present in large proportion, wherein M is the mass of the parent molecule and M+1 occurs due to hydrogen attachment. Accordingly, the plasma desorption method is better adapted to elemental analysis than to molecular structure analysis, for which it needs to be paired to a moderate or high resolution mass analyzer.

Ion resolution is improved in an instrument of a given time resolution by making the flight path of the ions as long as possible. Macfarlane and Torgerson used a plasma desorption spectrometer having a linear geometry. Other linear geometry instruments are also disclosed in U.S. Pat. Nos. 4,490,610 and 4,694,168. In a linear geometry, the flight region is generally cylindrical and bounded at both ends by an ion source and detectors. This geometry requires the instrument to be substantially longer than the flight region. It would be desirable to be able to increase the flight path length in an instrument of a given size by altering the positions of the various components which presently are positioned at the ends of the flight region.

SUMMARY OF THE INVENTION

One object of the invention is to provide an ion source wherein a sample can be collected onto a sample surface by condensing sample molecules out of a gas stream.

Thus, one embodiment of the invention provides an ion source with an inlet for sample injection and means for cooling a surface to condense molecules of a sample. In illustrations, the ion source further includes an assembly adapted for use in a plasma desorption spectrometer. The assembly supports a fission material and two foils on opposite sides of the fission material. One of the foils is cooled to a low temperature by means such as a circulating refrigerant to a low temperature to condense sample molecules onto the surface of the foil. The sample inlet directs a sample gas stream over the cooled foil causing a portion of the molecules of the gas stream to condense onto the foil in a homogeneous layer.

There is also provided a TOF mass spectrometer incorporating the ion source and assembly. The spectrometer further includes a start and a stop detector and a drift region, the assembly and drift (or flight) region being positioned between the detectors. A sample is injected through the sample inlet and is condensed onto a foil suspended in the assembly and facing the drift region. The start detector responds to electrons ejected from the other foil by a fission fragment emitted from the fission material and signals the beginning of a time measurement. Simultaneously, ions of a sample adsorbed onto the foil facing the drift region are ejected by an oppositely directed fission fragment. These sample ions traverse the flight region and are received by the stop detector, which sends a stop signal to the electronic circuitry.

Another object of the invention is to provide a TOF mass spectrometer with a maximum flight path length for an instrument of a given size. Accordingly, another embodiment of the invention provides a mass spectrometer having a reflective geometry to maximize flight path length.

In the reflective geometry, a fission source is positioned midway between a sample surface and a detector. A collector surface receives fission fragments which are used to generate a start signal at a start detector. Oppositely directed fission fragments strike the sample surface and eject sample ions. The sample ions are accelerated toward the stop detector. The sample surface is curved so that ions originating from any location on the sample surface will travel the same distance to reach the detector. In addition, the reflective geometry insures an equal match of fragment and sample collection efficiency.

In a mass spectrometer employing the reflective geometry, sample inlet tubes may be spaced apart around the circumference of the sample surface to direct a sample gas stream over the surface and a cooling means such as a refrigerant circulation coil may be used to cool the sample surface to condense the sample gas.

A sample may be mass analyzed in each mass spectrometer embodiment of the invention according to the method aspects of the invention. The instrument should first be evacuated. In the sample preparation method aspect of the invention, the sample surface is cooled and a sample is injected into the evacuated instrument through the sample inlet causing a portion of the gas sample to condense on the sample surface. The remainder of the injected sample in gaseous form may be removed by the operation of the evacuation pump. After the vacuum has stabilized, the electronic circuitry can begin acquiring data generated by desorbing and volatilizing a portion of the sample from the cooled surface and resolving the volatilized portion by mass. Cooling can be continued throughout data acquisition to reduce background noise. Afterwards, the instrument can be readied for another sample by ceasing cooling and allowing the remaining sample condensed on the sample surface to evaporate and be withdrawn by the evacuation pump.

DETAILED DESCRIPTION OF THE PREFERRED EMBODIMENT

Figure 1:
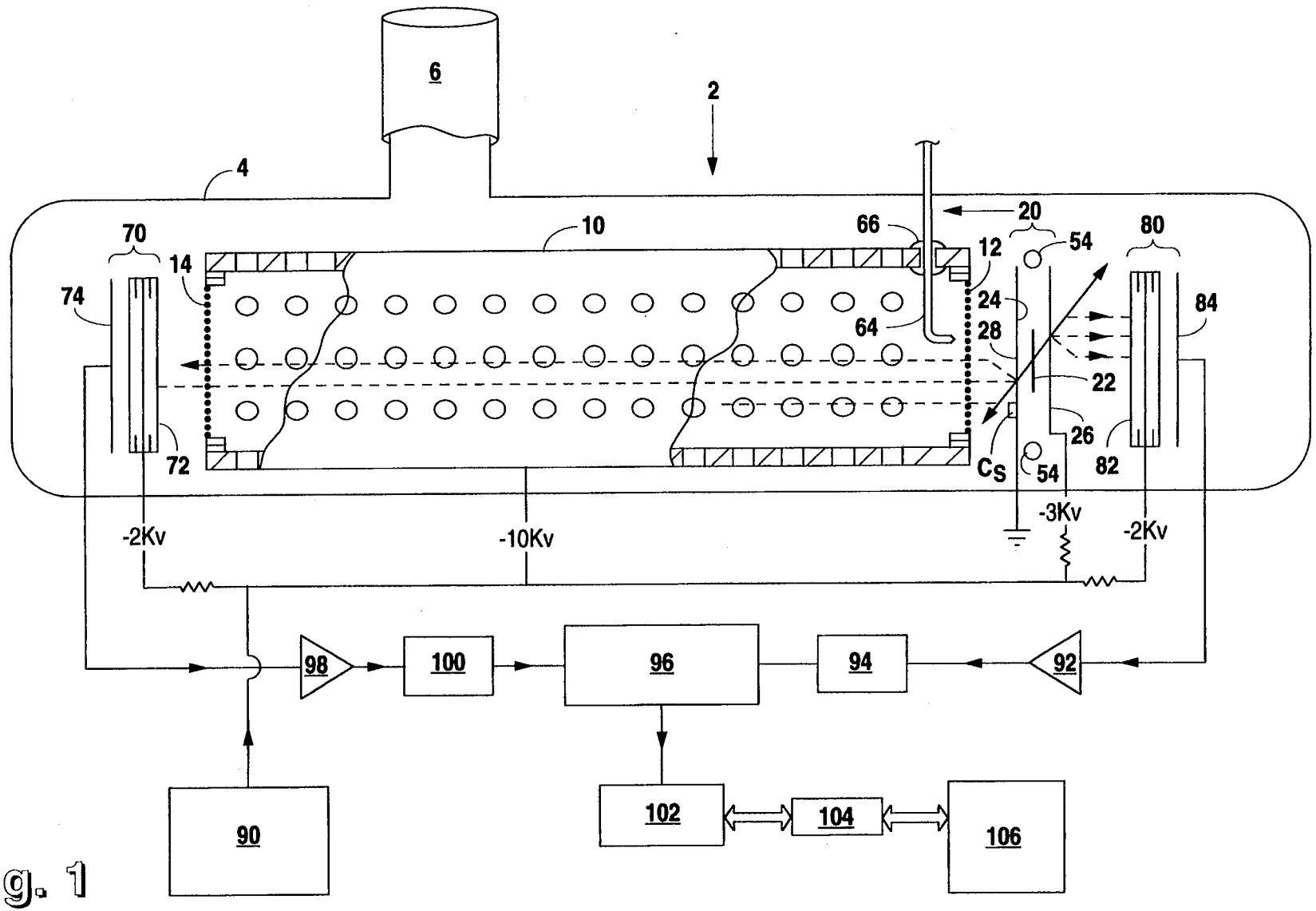
FIG. 1 illustrates a TOF mass spectrometer according to the invention having a linear geometry.

FIG. 1 depicts a compact mass spectrometer 2 which is enclosed in airtight chamber 4 equipped with an evacuation pump 6. Pump 6 may be, for example, an ion or turbomolecular pump which is capable of reducing the pressure in airtight chamber 4 sufficient to allow operation of the detectors and to resolve sample information from background noise.

Mass spectrometer 2 is a collinear arrangement of detectors 70 and 80, and flight tube 10 and ion source 20 positioned between the detectors. Start detector 80 responds to a fission event in ion source 20 and initiates a time measurement in the electronic circuitry. Sample ions generated in ion source 20 traverse flight tube 10 (dashed lines trace idealized flight paths) and are detected by stop detector 70. Stop detector 70 transmits a stop signal to the system's electronic circuitry which records a time interval value that is processed as an ion count on a mass spectrum.

Sample ionization is induced by fission fragments emitted from fission material 22. For equal detection efficiency of start and stop events, a suitable fission material 22 should produce oppositely directed fragments. Fission material 22 is preferably $^{252}Cf$, which is commercially available in about 1 to about 50 $\mu$Ci quantities wrapped in nickel foil envelopes. Though alpha emission is the dominant mode of $^{252}Cf$ decay, asymmetric nuclear fission also occurs and produces a pair of high energy nuclear fragments and one alpha particle. More than 40 different fragment pairs are possible and sufficient high energy pairs ($\sim$100 MeV) are produced that a fission event rate of $5\times10^4$/sec. can be obtained from about a 0.1 to about 50 $\mu$Ci sample. The total radiation dose due to all fisson fragments including neutrons, alphas and gammas is within the current industrial exposure standard of 0.57 mRem/hr.

$^{252}Cf$ fission pairs are emitted in almost opposite directions. As illustrated, sample foil 24 and start pulse foil 26 are positioned on opposite sides of fission material 22. One fragment originating from fission material 22 strikes start pulse foil 26 and ejects secondary electrons. The other fragment simultaneously strikes sample foil 24 and volatilizes and desorbs ions of sample adsorbed onto surface 28 of sample foil 24. Foils 24 and 26 have diameters substantially greater than the size of fission material 22 and equal to each other to insure equally probable interception of fragments.

Foils 24 and 26 may comprise any suitable material that will withstand the rigors of the process and are of suitable structural integrity. Such materials include, but are not limited to, carbon, nickel, mylar and titanium; carbon and nickel being preferred. Generally the thickness of foils 24 and 26 is on the order of microns so that the fission fragments can penetrate the foil with a kenetic energy loss of about 20 MeV or less. The foils may be mounted on a high transparency mesh (e.g., >95%) for support if needed.

Start pulse foil 26 is charged with a negative potential, e.g. −3 kV as shown in FIG. 1. Electrons ejected from start pulse foil 26 by interaction with a fission fragment are thus repelled in the direction of start detector 80. These intercept microchannel plate (MCP) stack 82 of start detector 80. Conventional 2.5 cm diameter microchannel plates ("MCP") such as are commercial available may be used. As illustrated, start MCP stack 82 includes 3 MCPs in order to achieve sufficient multiplication gain for good signal processing. Start MCP stack 82 is charged with a negative potential, less than the start pulse foil potential, e.g. −2 kV as shown. The MCPs are at decreasing negative potentials from top to bottom of the stack, e.g. −2 kV, −1 kV, and −500 V. Electrons are ejected from the semiconducting glass channels of the microchannel plates by interaction with electrons ejected from start pulse foil 26 and resulting electron cascade strengthens the start pulse. The electrons are picked up at grounded anode 84 which supplies a starting signal $T_0$ to the electronic circuitry and initiates a time counting interval.

Sample foil 24 is positioned between fission material 22 and flight tube 10 with the sample deposited on the foil surface facing flight tube 10 (hereafter "the sample surface" of the linear geometry). The excitation energy given to the sample by a fission fragment ionizes and volatilizes sample molecules. Desorbed ions have free path into flight tube 10. Sample foil 24 is grounded so as not to generate electric fields that would affect the flight path of sample ions. In addition, its grounding helps shield the sample ions from the field effects of the electrical potential on start pulse foil 26.

Flight tube 10 may be made with any conducting material such as stainless steel, aluminum, graphite or a close knit mesh of conducting material. As depicted, flight tube 10 is made of perforated metal pipe for high pumping throughput and may alternatively be made of suitably supported mesh. Flight tube 10 is preferably charged with a sufficiently high potential to provide a shielding effect against electric fields from other sources. The electric field also attracts and accelerates ejected ions into flight tube 10, for which purpose the field strength may vary greatly from the exemplary −10 kV potential. In the field generated by the negative potential on flight tube 10, positive ions gain the necessary kinetic energy and are accelerated into the flight tube. Negative ions are repelled and escape detection. The polarity of the electric field can be reversed to detect negative ions provided the stop detector bias voltage is also changed to allow electron multiplication in the MCP.

Highly transparent mesh grids 12 and 14 made of conducting material are provided at the ends of flight tube 10 to make the electric field between the flight tube 10 and sample foil 24 uniform. As a result, sample ions are accelerated over the same distance and to the same kinetic energy regardless of their initial flight path. Upon entering flight tube 10, these ions are no longer accelerated and drift at constant velocities in the uniform field of the drift region toward stop detector 70.

As the sample ions reach the end of flight tube 26 they pass through grid 12 and leave the shielded drift region. Sample ions accelerate toward stop detector 70 under the field effects of stop MCP stack 72 which is negatively charged, e.g. −2 kV as shown. On impact of a sample ion, electrons cascade through the stop MCP stack 72 and are received at grounded anode 74 and supply a stop signal $T_i$ to the electronic circuitry. Stop MCP stack 72 preferably contains three MCPs similar to those of start MCP stack 82 in order to achieve necessary gain.

Figure 2:
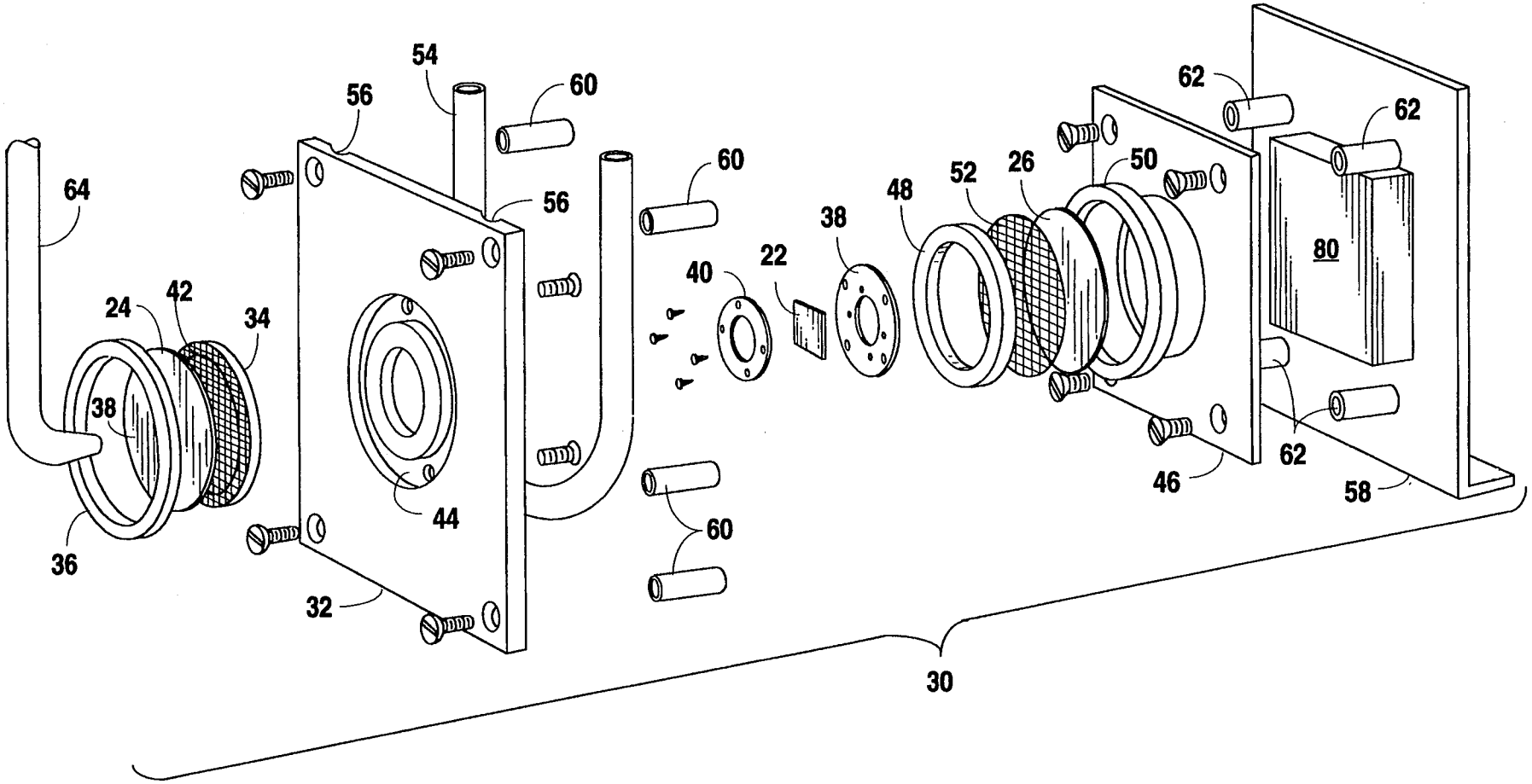
FIG. 2 is an exploded view of an embodiment of the ion source of the invention adapted for use in a TOF mass spectrometer having a linear geometry.
Figure 3:
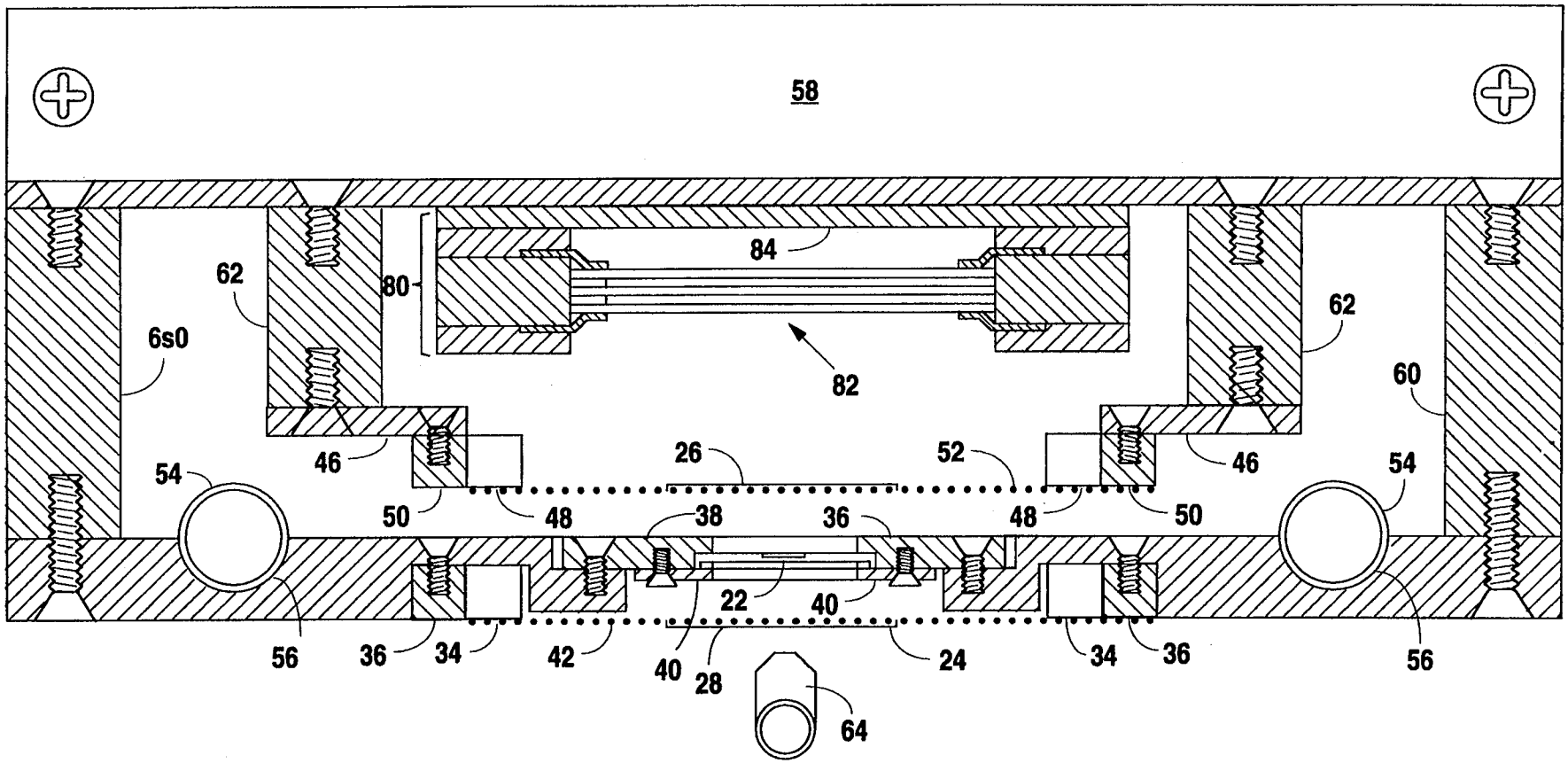
FIG. 3 is a cross sectional view of an embodiment of the ion source and start detector of a TOF mass spectrometer having a linear geometry.

One feature of the invention is that the sample is deposited onto sample surface 28 by condensing and absorbing sample molecules out of a gas stream. FIGS. 2 and 3 illustrate an exemplary ion source with sample condensing capability.

The ion source includes an assembly of plates, standoffs and rings which are secured together by screws, generally designated 30. Certain operative components of the ion source, including sample foil 24, fission material 22, and start pulse foil 26, are supported and aligned by the assembly in the exemplary configuration as hereafter described. Of course, the assembly could differ greatly from the exemplary illustrations and description and yet effectively serve its purpose to support, insulate and align the operative components.

As depicted, plate 32 mounts sample foil 24 and fission material 22 by means of retaining rings 34, 36 and 38, 40, respectively.

Preferably, rings 34 and 36 make a concentric fit and a mesh 42 is press fit between rings 34 and 36. Mesh 42 is preferably made of photochemically deposited metal, such as nickel, for good transparency and support. Alternatively sample foil 24 may be press fit between rings 34 and 36 without a support screen for maximum transparency. Rings 34, 36 suspending a sample foil and/or mesh screen 42 fit within concentric recessed portion 44 of plate 32 and are held in place, for example by screws penetrating plate 32 through recessed portion 44 and threaded to sockets in ring 36.

Rings 38 and 40 preferably align "face-on" for holding commercially available $^{252}$Cf in nickel envelopes and may be attached to plate 32 by screws. Rings 38 and 40 fit within a circular recess in plate 32, as can best be seen in the cross sectional view of FIG. 3.

Plate 46 mounts the start pulse foil behind the fission material. Start pulse foil 26 may be mounted to plate 46 in the same manner as the sample foil is mounted to plate 32, i.e. by means of concentrically fitting rings 48 and 50 attachable to plate 46 by screws, as illustrated. Wherein the sample foil is suspended on screen 42, it is also desirable to provide a similar screen 52 for suspending the start pulse foil to ensure equal transparency to fission fragments.

A refrigerant circulation coil 54 is positioned in proximity to sample foil 24 for cooling the sample foil to condense a gaseous sample onto sample surface 28. Refrigerant circulation coil 54 is preferably in physical contact with plate 32 for improved conductive heat transfer from the sample foil to the circulating refrigerant. However, refrigerant coil 54 need not be in contacting relationship with either plate 32, screen 42 or sample foil 24 since heat transfer is principally radiative. As illustrated in FIG. 2, refrigerant coil 54 is a separate tube shaped to conform to a U-shaped groove 56 in plate 32 and fixed within groove 56 such as by soldering. Of course, refrigerant coil 54 may have a U—or any other—shape and may be a physical part of plate 32 by manufacturing same with a hollow core or forming a channel therein. Refrigerant coil 54 may be connected to a conventional refrigeration unit having a compressor and heat exchanger to complete the refrigeration system. Alternatively, vessel for containing a cooled liquid which can be emptied and refilled could replace coil 54, without the need for connection to a compressor or heat exchanger. Alternatively, a thermoelectric cooling plate (not illustrated) may be used to achieve the cooling effect of the refrigerant. As can be appreciated, a thermoelectric cooling plate for cooling the sample foil, would be aligned concentrically around the radial center of the sample foil, and would have leads to connect to a current source.

In FIGS. 2 and 3, cooling is somewhat localized to the ion source by mounting plates 32 and 46 to a backing plate 58 by means of standoffs 60 and 62. The standoffs may be made of thermally insulating material to reduce conductive heat flow into the ion source. By positioning plate 46 a distance apart from backing plate 58, space can be provided for start detector 80, as illustrated in the cross sectional view of FIG. 3.

An instrument might also be constructed wherein other components are cooled. For example, a refrigerant circulation coil could also encircle flight tube 10 to condense molecules, such as contaminants, thereon prior to mass analysis in order to reduce background contamination.

Any liquid or gas may be used as a refrigerant, though for obtaining temperatures of −40° C. and below, a cryogenic liquid, such as liquid nitrogen is preferred. Generally, when a cryogenic liquid refrigerant is used a thermoelectric cooling plate is unnecessary.

Sample inlet tube 64 directs a sample gas stream over sample surface 28. Sample inlet tube 64 is preferably a capillary tube having an I.D. in the range of about 10 μm to about 100 μm. Preferably, sample inlet tube 64 terminates several millimeters, e.g. about 5 mm, apart from the radial center of sample foil 24, which position may be approximated with reference to rings 34, and 36. Alternatively, capillary inlet tube 64 may terminate alongside the sample foil, though any advantage that positioning the end of the inlet tube askew of the center has on ion transparency is generally compensated by the more even distribution of sample when the inlet tube terminates at the radial center of the foil. As illustrated in FIG. 1, sample inlet tube 64 may be made to pass through flight tube 10, in which case sample inlet tube 64 may be insulated by grommet 66 to prevent arcing. Alternatively, sample inlet tube 64 may be positioned between flight tube 10 and assembly 30, though there is some loss of instrument sensitivity as the inlet tube is moved closer to the sample surface. Inlet tube 64 extends outside of chamber 4 and is adapted to receive samples from, for example, the needle of a syringe or a slip stream taken from the output gas stream of a gas chromatograph.

It is also understood that the sampling may be conducted utilizing a programmable valve, such as a precision leak valve.

Figure 5:
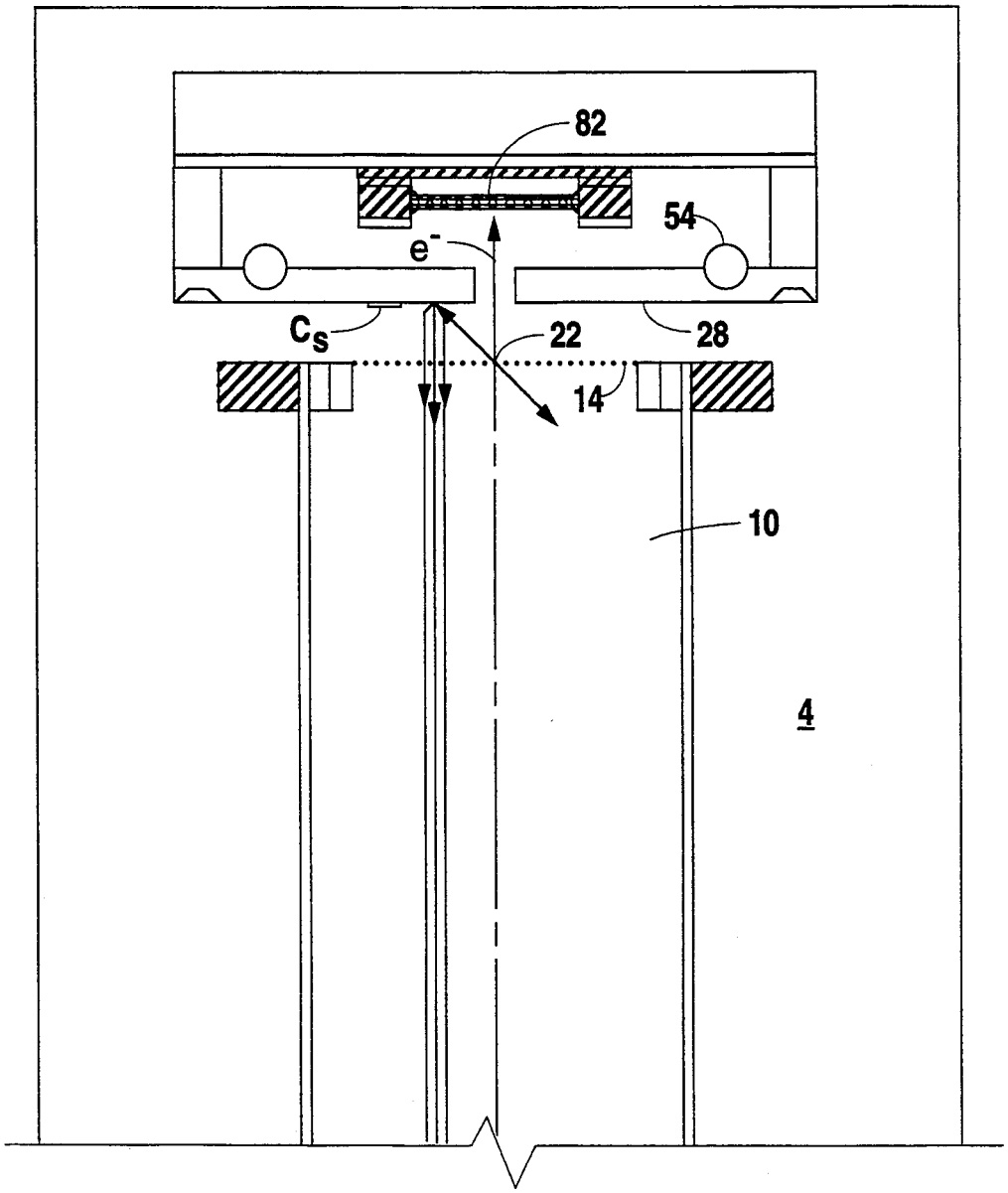
FIG. 5 shows an alternative geometry to the geometry shown in FIG. 1.

As an alternative embodiment to the geometry shown in FIG. 1, the geometry shown in FIG. 5 may easily be configured from the components in FIG. 1 and utilized in the present invention. This geometry allows for better cooling of the sample while maintaining in large part, the transmission geometry. Cf is in the same plane as the grid supported by spokes which attach it to the flight tube. The sample is frozen out on the face of an annular cylinder containing an inert cooling medium, such as liquid nitrogen. As fission fragments are emitted from the foil, electrons are generated in the Ni containment foil. When the flight tube is negatively biased, the electrons are accelerated through the hole down the center of the cylinder, and out onto the start MCP stack. The fission fragments hit the front surface of the cylinder, desorbing sample ions, which are then accelerated down the flight tube as in the geometry of FIG. 1. An important feature of this geometry is that it is the most efficient reflective geometry and allows for the easiest cooling.

Figure 4:
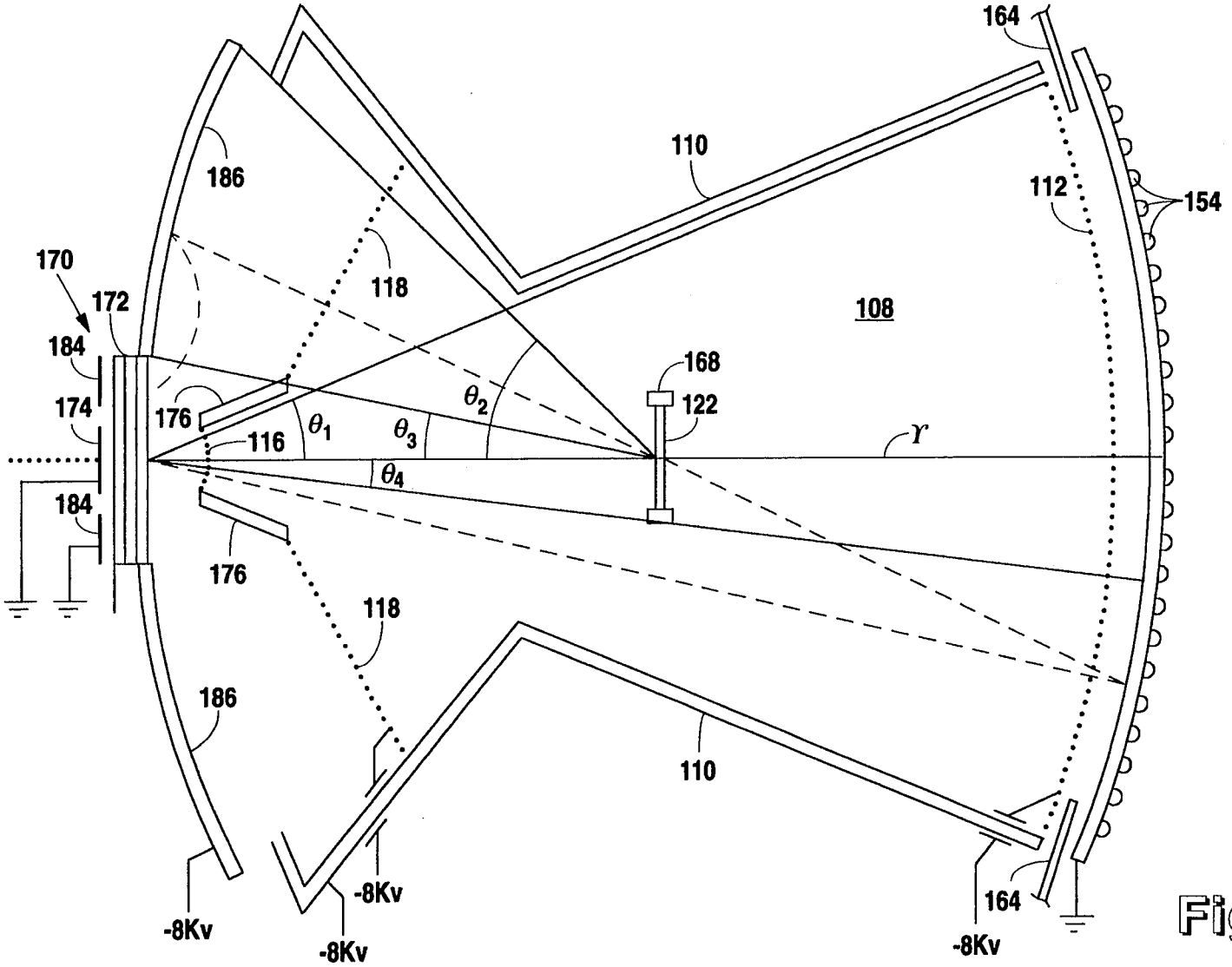
FIG. 4 is a cross sectional view of a mass spectrometer according to the invention having a reflective geometry.

The geometries shown in FIGS. 1, 4 and 5 may be utilized with other forms of desorption, such as, electron avalanche desorption and spontaneous desorption.

In the practice of all embodiments of the present invention, multiple samples may be consecutively condensed without opening or warming the sample region by depositing a known medium prior to each sample deposition. The idea is to cover the previous sample with a medium with a known spectrum containing no hydrocarbons that will not substantially interact, react or otherwise disturb the integrity of the sample, such as, for example, water, halides or other compounds.

FIG. 1 also schematically illustrates the power source and the electronic circuitry useful for processing data obtained from the mass spectrometer.

A single power source 90 supplies the current required by the circuitry and the programmable potential required by flight tube 10, start and stop detectors 70 and 80, and start pulse foil 26 of the mass spectrometer.

A start signal $T_0$ from start anode 84 is transmitted to preamp 92 which amplifies, provides impedance matching, and transmits the start signal to constant fraction discriminator 94. Constant fraction discriminator 94 is parameterized to accept signals corresponding to the start anode output generated by a fission fragment and to reject smaller signals generated by an alpha particle. Constant fraction discriminator 94 transmits start signals which have been accepted to a time to digital converter 96. A time to digital convertor ("TDC") capable of highly accurate time measurements is disclosed in commonly assigned, co-pending U.S. application Ser. No. 07/493,507, filed Mar. 14, 1990. Commercially available TDC may also be used for non-portable applications. Time to digital converter 96 initiates a time measurement interval in response to the start signal. A stop signal $T_i$ originating from stop anode 74 is sent through preamplifier 98 to constant fraction discriminator 100 which transmits accepted signals to time to digital convertor 96.

Having received start interval $T_0$, time to digital convertor 96 can accept, in a predetermined time interval, sixteen or more stop signals. The time interval spanning $T_0$ and the arrival of a stop signal $T_i$ is transmitted as a digital word to histogrammer 102.

In histogrammer 102, each digital word is allocated to a memory address corresponding to the encoded time interval and increments that memory address by one. A mass spectrum is formed by accumulating time intervals over a multitude of $T_0$ events.

Fission events may occur at intervals on the order of milliseconds or less. Flight times may span time intervals on the order of microseconds. Thus a non-negligible proportion of the time intervals will record stop events corresponding to ions generated by two nearly simultaneous fission events. Accumulating data over a large number of fission events effectively attenuates the spurious information received from two near simultaneous start signals. Since the response time of the electronics is on the order of nanoseconds, the electronics causes negligible measurement error.

The output of histogrammer 102 may be transmitted through an interface card 104 to a portable computer 106 where the mass spectrum can be further processed, displayed on the video screen, and recorded in permanent memory.

Having thus described the essential components of the illustrated embodiment of FIG. 1, its use is further described along with the novel sample deposition technique made practicable by cooling the sample foil.

Introduction of a sample into the instrument is preceded by evacuation of the instrument to low enough pressure to prevent sample contamination caused by condensation of contaminant gases onto the sample foil. Generally, the operating pressure of the instrument or $10^{-5}$ torr or less is sufficient.

Refrigerant is circulated through coil 54 until sample foil 24 attains a sufficiently low temperature to condense the sample gas. For many volatile materials that are likely to be of interest, a temperature of −40° C. is adequate.

A portion of the molecules in the gas stream exit sample inlet tube 64, strike sample surface 28 and are condensed thereon. Other molecules are withdrawn from the mass spectrometer by pump 6 while others may condense on other cooled surfaces of the mass spectrometer.

Sample molecules condensed on other surfaces of the mass spectrometer are a potential source of noise (false $T_i$'s). For this reason, cooling is continued throughout data acquisition to keep stray sample molecules in the condensed state. In an alternative construction wherein flight tube 10 is also cooled by an encircling refrigeration coil, flight tube 10 should also be cooled during data acquisition.

Gas flow through the sample inlet tube 64 is ceased and the pressure in the instrument is allowed to stabilized at the operating pressure of the instrument before activating the electronic circuitry to accumulate data.

After accumulating a mass spectrum, the instrument can be easily prepared for analysis of another sample by ceasing refrigeration. As the instrument returns to ambient temperature, sample molecules condensed onto the sample surface and other surfaces evaporate and are expelled through pump 6. A heating system may be incorporated into the instrument to assist in evaporating low volatility samples and in speeding up preparation for the next sample.

As can now be appreciated, a single sample foil may be used for many sample analyses, thus avoiding the delicate task of replacing the sample foil and repeated breaking of the vacuum by opening the instrument to replace the sample foil. Other embodiments include a mechanism for handling multiple sample foils and rotating or otherwise positioning them for analysis or sample deposition. Such sample replacement mechanisms are not limited to, but may include carousel foils, wheels, or continuous ribbons.

In an alternative embodiment, a TOF mass spectrometer employing sample condensation has a reflective geometry. FIG. 4 is a cross sectional view of such an instrument whose shape is suggestive of two frustoconical sections joined at their tops and having convex bases. The convex bases form a front wall 178 bearing a sample surface 128 onto which a quantity of sample is deposited and a back wall mounting an ion detector 170, and collector surface 186.

In the novel reflection geometry of this instrument, fission material 122 is held in a separate fission source 168 spaced apart from sample surface 128 and a single detector 170 receives both electron and ion impacts signalling start and stop events, respectively. Other advantages of this design will become apparent from the following detailed description.

Detector 170 and fission source 168 define a symmetry axis containing line r whose length spans flight chamber 108 from the radial center of detector 170 to the radial center of sample surface 128. Fission source 168 is positioned on r equidistant between detector 170 and the sample surface.

While the instrument is further described with reference to the cross sectional view of FIG. 4, one skilled in the art will appreciate that the instrument is in fact three dimensional. Accordingly, an angle of magnitude $\Theta$ defines a conical shape or region obtained by rotation of the angle around the r containing symmetry axis. Likewise, the arc of a circle subtending an angle of magnitude $\Theta$ actually defines the surface obtained by rotation of the arc around the r containing symmetry axis.

The geometry of flight chamber 108 is defined in the first instance by a forwardly directed angle of magnitude $\Theta_1$ centered on detector 170. $\Theta_1$ may vary o from about 15° to about 30° depending on the size of the instrument and the size of the sample surface.

Sample surface 128 is formed on the back side of front wall 178 and has a contour defined by the arc of a circle of radius r centered on detector 170 and subtending the angle of magnitude $\Theta_1$.

Collector surface 186 encircles detector 170 and has an outer circumference delimited by a backwardly directed angle of magnitude $\Theta_2$ centered on fission source 168. $\Theta_2$ is chosen to be approximately twice $\Theta_1$ such that fission source 168 illuminates equal solid angles of sample surface 128 and the back wall comprising collector surface 186 and detector 170. $\Theta_2$ defines only the size of collector surface 186, not its contour. The contour of collector surface 186 is defined by the arc of a circle centered on the intersection of r with sample surface 128 and having a radius r. Thus, sample surface 128 and collector surface 186 have the same radii r which is the distance from detector 170 to sample surface 128. This insures that oppositely directed fission fragments strike sample surface 128 and collector surface 186 simultaneously. Since collector surface 186 and sample surface 128 are not concentric on fission source 168, fragment pairs will travel different distances depending on the angle of emission relative to r. However, each fragment of a given pair will travel the same distance since they are oppositely directed.

A backwardly directed angle of magnitude $\Theta_3$ delimits the inner circumference of collector surface 186 and therefore marks an area on the back wall which is occluded from fission fragment interaction with collector surface 186. The occluded area may be occupied entirely by detector 170 or by the detector and an encircling region that does not emit electrons in response to an impact from a fission fragment.

Fission source 168 subtends another angle of occlusion of magnitude $\Theta_4$ centered on detector 170 and forwardly directed. This angle marks an occluded area on sample surface 128 where desorbed ions will be deflected or adsorbed by interaction with fission source 168.

$\Theta_3$ and $\Theta_4$ are determined by carefully sizing collector surface 186 and fission source 168 so that $\Theta_4$ is equal to $\frac{1}{2}$ of $\Theta_3$. When properly sized, sample ion occlusion by fission source 168 and occlusion of the start signal-generating fragment combine to insure that sample ions which escape detection because of occlusion by fission source 168 will not be preceded by a start signal.

Collector cone 176 is positioned in front of detector 170 and is sized to coincide with the occlusion angle of magnitude $\Theta_3$. Collector cone 176 partially shields detector 170 from fission fragments which are too closely parallel with r to generate non-occluded, detectable sample ions. This reduces the frequency of false starts resulting from direct incidence of fission fragments on detector 170. Collector cone 176 is open at both its narrow end and its wide end. Focusing grid 116 spans the narrow end of collector cone 176 and has a slight curvature. The curvature of focusing grid 116 corrects for deviations in flight path length of ions emitted from different positions on sample surface 128 by focusing ions onto the center of detector 170. In the absence of a focusing grid, accurate flight times could only be obtained with a detector having a curved surface or with some other compensating arrangement. With grid 116, detector 170 may have a planar surface without significant peak broadening. The focusing grid's radium of curvature can be adjusted to make all sample ion flight times equal (for equal mass) and, secondarily, to keep ion focus as small as possible consistent with equal TOF's.

The reflective geometry described here insures an equal match of fission fragment collection efficiency for both fragment and sample collection, which improves the signal to noise ratio. Furthermore, ion concentration on the detector by the geometry and the focusing grid enables a reduction in size of the detector which further increases the signal to noise ratio.

In a mass spectrometer having the reflective geometry just described, collector surface 186 is charged with a negative potential, such as −8 kV as shown in FIG. 4. Detector 170 may be similar to those previously described with reference to the linear geometry, which include a stack of MCPs and an anode. The MCPs may be maintained at the same potential or at differing potentials such that the MCP closest to the anode is charged with the least negative, or most positive, electrical potential. In either case, MCP stack 172 is maintained at a lesser negative charge (or a positive charge) relative to collector surface 186 so as to attract electrons ejected by impact of a fission fragment on collector surface 186. Electrons emitted from collector surface 186 will have slightly different travel times depending on the location of the emission. These differences are insignificant compared to the flight time of sample ions, on the order of 0.1%, and in any event can be minimized by selecting the shape of grid 118 and the adjacent wall of 110. Note that the details of 118 have no effect on the flight of the very high energy (>100 MeV) fission fragments. Also, surfaces 118, 176, 116, 110, and 112 define a field-free region for sample ions, but the actual location or shape of 118 amd 110 have no effect on travel times.

Detector 170 may include only a single anode, in which case signals generated by fission fragments and sample ions may be distinguished by the electronic circuitry into start and stop signals. Preferably, however, detector 170 includes a small stop anode 174 aligned with the narrow opening of collector cone 176 and an encircling start anode 184. Start anode 184 receives a cascade of electrons emitted by the MCP stack in response to electrons from collector surface 186 impinging on the peripheral regions of the MCP stack. The much smaller stop anode 174 receives electrons cascading from the central region of the MCP stack in response to impinging sample ions focused into the center by focusing grid 116.

A flight chamber 110 is provided to shield flight region 108 from stray electric fields and to provide for attachment of grids 112 and 118. Flight chamber 110 may be shaped in the form of two frustoconical sections joined at their tops and having the cross section illustrated in FIG. 4. However, the flight chamber may be of any shape that accommodates (i.e. does not intersect) the conical regions defined by the angles of magnitudes $\Theta_1$ and $\Theta_2$. Flight chamber 110 may be made from any conducting metal such as aluminum or stainless steel, and is preferably perforated or made of mesh for improved instrument evacuation.

Collector grid 118 encircles collector cone 176 and extends outward to flight chamber 110. Toward the front of the instrument, sample grid 112 spans the flight chamber adjacent to sample surface 118 and has a curvature closely approximating the contour of sample surface 128. Grids 112, 116, and 118 preferably have a mesh of >80% transmittion. They may be made out of any electrical conductor such as nickel, stainless steel, copper, beryllium, with nickel being preferred.

Each of grids 112, 116 and 118 and flight chamber 110 is charged with either positive or negative potential, depending on the polarity of the sample ions of interest. Each is preferably maintained at the same potential, which is further preferably the same potential as exists on collector surface 186. In this way, the power supply to the instrument may be simplified.

Sample molecules are condensed on sample surface 128 which is cooled to low temperature by, for example, a refrigeration coil 154 on the front side of front wall 178. Cooling can be efficiently localized to the sample surface 118 and front wall 178 by spacing flight chamber 110 apart from front wall 178 or by separating the two by means of a thermally insulating interface material. For example, the chamber 110 may be made of an insulating substrate and covered with a thin layer of conducting material such as aluminum or gold.

Sample molecules are condensed onto the cooled sample surface 128 by injecting a gaseous sample into the region adjacent the sample surface 128 via one or more sample inlet tubes 164. When more than one inlet tube is used, they may be spaced apart around the circumference of sample surface 128 for more homogenous deposition. Sample inlet tubes 164 may extend substantially or only a small distance into the region between sample grid 112 and sample surface 128. For instance one or more tubes may approach the radial center of the sample surface. The distance from the open ends of the inlet tubes 164 to sample surface 128 will depend in large part on the size of the sample surface and the number of inlet tubes provided, and can be determined from comparison of the instrument sensitivity obtained from a variety of configurations.

After evacuation of the instrument, cooling of sample surface 128 to low temperature, e.g. −40° C., and deposition of the sample, the electronic circuitry (such as that previously described) begins to accumulate start events and associated stop events.

Fission source 168 emits fission fragments in opposite directions. A proportion of these events, depending on the magnitude $\Theta_1$, emit a fragment in the direction of sample surface 128. For example, a fragment following a path indicated in FIG. 4 by dashes is intercepted by sample surface 128 causing sample ions to be ejected from the surface.

Simultaneously, an oppositely directed fragment strikes collector surface 186 and ejects electrons therefrom. These electrons are attracted to the MCP stack 172 and impinge upon the stack near its periphery. Their arrival causes an electron cascade in MCP stack 172. The resulting electron pulse is localized to the peripheral region and is detected by peripheral start anode 184 which transmits a $T_0$ signal to the electronic circuitry to initialize a time counting interval. This process, commencing with ejection of electrons from collector surface 186, occurs within a few nanoseconds.

At the front of the instrument, ejected sample ions of opposite polarity to sample grid 112 are accelerated away from and approximately normal to the sample surface and into flight region 108. Sample ions drift through the region along paths which direct them into collector cone 176. Since sample surface 128 is defined by the arc of a circle centered on detector 170, ions emitted from all points of the sample surface travel equal distances and are first order isochronous. Conversely, ions with widely divergent trajectories and therefore travel times are excluded from the detector region defined by the central anode 174. As sample ions pass out the narrow end of collector cone 176, they are colineated by focusing grid 116 toward the center of MCP stack 172. The impact of sample ions near the center of the first MCP initiates a cascade of electrons which travel down the microchannels of the center area and are emitted from the back end of the MCP stack. A centrally localized electron pulse is detected by stop 174 anode which transmits a $T_i$ to the electronic circuitry.

As will be appreciated by one skilled in the art, the reflective design of FIG. 4 possesses advantages not shared by the collinear arrangement depicted in FIG. 1 and not previously available to the art. While employing the sample deposition technique of the linear design, sample ions are ejected by direct impacts from the fission source. Thus, an impinging fission fragment will possess greater kinetic energy when it reacts with the sample, causing more sample ions to be released with each impact. Therefore, a greater measure of sensitivity is attained. In addition, the problem of occlusion, which is inherent in a reflective geometry, is overcome by sizing collector surface 186 and fission source 168 so that the start signal-generating fragment is occluded whenever the other fragment would strike an occluded area of sample surface 128. Therefore, stop events which are likely to occur at an erroneous time, or simply not occur, because of interaction with fission source 168 are not recorded since their associated start signals escape detection. In addition, since the flight path of sample ions spans the entire length of the instrument, but for the widths of detector 170 and front wall 178, a maximum resolution for a given instrument length is attained. Yet further, the cost and size of the instrument is reduced by employing only one MCP stack.

As will be appreciated by those skilled in the art, the inventive geometry might be applied wherein the narrow end of collector cone 176 is substituted for detector 170 as the point used to define the angles of magnitude $\Theta_1$, $\Theta_4$ and the contour of sample surface 128.

Having thus described the invention with reference to certain illustrated embodiments, those of ordinary skill in the art may, upon reading this disclosure, appreciate additional changes which can be made which do not depart from the spirit of the invention as described above and the scope of the invention as claimed hereafter.

What is claimed is:

1. In a mass spectrometer wherein a quantity of sample to be mass analyzed is deposited onto a surface of a sample foil, an ion source comprising:

a sample inlet tube for directing a gaseous sample toward the surface of the sample foil;

means for cooling the surface of the sample foil to low enough temperature to condense molecules of the gaseous sample onto the surface of the sample foil; and an assembly for mounting a fission material and the sample foil.

2. In a mass spectrometer wherein a quantity of sample to be mass analyzed is deposited onto a surface of a sample foil, an ion source comprising:

a sample inlet tube for directing a gaseous sample toward the surface of the sample foil;

means for cooling the surface of the sample foil to low enough temperature to condense molecules of the gaseous sample onto the surface of the sample foil; and an assembly for mounting a fission material, the sample foil, and a second foil.

3. In a mass spectrometer wherein a quantity of sample to be mass analyzed is deposited onto a surface of a sample foil, an ion source comprising:

a sample inlet tube for directing a gaseous sample toward the surface of the sample foil;

means for cooling the surface of the sample foil to low enough temperature to condense molecules of the gaseous sample onto the surface of the sample foil; and an assembly for mounting a fission material, the sample foil, and a second foil, wherein said assembly arranges the sample foil and said second foil to lie on opposite sides of said fission material;

wherein the interaction of a fission fragment emitted from said fission material with said second foil ejects electrons from said second foil, and the interaction of a fission fragment emitted from said fission material with the sample foil volatilizes and ionizes the condensed sample on the surface of the sample foil.

4. A time of flight mass spectrometer comprising:

a. a drift region;

b. an assembly for mounting a sample foil, a second foil, and a fission material;

c. means for cooling the sample foil mounted in the assembly;

d. a sample inlet tube for directing molecules of a gaseous sample toward the sample foil;

e. a detector for receiving electrons ejected from the second foil by interaction with a first fission fragment emitted by the fission material; and, f. another detector for receiving sample ions ejected from the sample foil by interaction with a second fission fragment emitted by the fission material after the sample ions have passed through the drift region, wherein the second fission fragment is emitted simultaneously with the first fission fragment;

wherein, a sample to be mass analyzed is collected by cooling the sample foil and injecting the sample through the sample inlet tube, causing the molecules of the sample to condense onto the cooled sample foil.

5. The mass spectrometer of claim 4 wherein the detectors, and the assembly are arranged substantially collinearly.

6. The mass spectrometer of claim 4 wherein the drift region is delimited by a metal tube.

7. The mass spectrometer of claim 6 wherein the metal tube has conductive metal grids.

8. The mass spectrometer of claim 7 wherein the metal grids span the metal tube at its ends.

9. The mass spectrometer of claim 4 wherein each detector comprises a single or a stack of microchannel plates and an anode.

10. The mass spectrometer of claim 4 wherein the cooling means includes a coil for circulating a refrigerant.

11. The mass spectrometer of claim 4 wherein the cooling means includes a vessel for containing a cooled liquid.

12. A time of flight mass spectrometer comprising a detector separated a distance r from a wall as measured along an axis passing through both said detector and said wall, a fission source positioned approximately equidistant between said detector and said wall along the axis, and a collector surface, the wall forming a sample surface, wherein:

a. a contour of the sample surface is determined by rotating about the axis an arc of radius r centered on the detector and subtending an angle of magnitude $\Theta_1$;

b. a contour of the collector surface is determined by rotating about the axis an arc of radius r centered on the intersection of the axis with a front surface of the wall wherein the arc spans between an inner and outer extents;

(1) the inner extent being determined by an angle of magnitude $\Theta_3$ centered on the fission source; and (2) the outer extent being determined by an angle of magnitude $\Theta_2$ centered on the fission source;

further wherein the fission source subtends an angle of magnitude $\Theta_4$ centered on the detector and $\Theta_4$ is approximately $\frac{1}{2}$ of $\Theta_3$.

13. The mass spectrometer of claim 12 wherein $\Theta_1$ is selected to be between about 15° and 30°.

14. The mass spectrometer of claim 12 wherein $\Theta_2$ is approximately twice $\Theta_1$.

15. A time of flight mass spectrometer comprising:

a. a detector;

b. a sample surface formed on a wall spaced apart from the detector a distance r;

c. a fission source positioned approximately equidistant between the detector and the sample surface, the detector and the fission source defining an axis;

d. a collector surface encircling the detector; and e. a collector cone open at both ends positioned between the detector and the fission source.

16. The mass spectrometer of claim 15 wherein the sample surface has a contour determined by rotation about the axis of an arc of radius r centered on the detector and subtending an angle of magnitude $\Theta_1$ centered on the detector.

17. The mass spectrometer of claim 16 wherein the collector surface subtends an angle of magnitude $\Theta_2$ centered on the fission source and $\Theta_2$ is approximately twice $\Theta_1$.

18. The mass spectrometer of claim 17 further comprising a flight chamber shaped to accommodate the angles of magnitude $\Theta_1$ and $\Theta_2$, the flight chamber defining a flight region.

19. The mass spectrometer of claim 18 further comprising a grid spanning the flight region adjacent to the sample surface.

20. The mass spectrometer of claim 18 further comprising a grid spanning the flight region from the collector cone to the flight chamber.

21. The mass spectrometer of claim 15 wherein the collector surface has an inner circumference determined by rotation about the axis of an angle of magnitude $\Theta_3$ centered on the fission source and further wherein the fission source subtends an angle of magnitude $\Theta_4$ centered on the detector and $\Theta_4$ is about $\frac{1}{2}\Theta_3$.

22. The mass spectrometer of claim 15 wherein the collector surface has a contour determined by rotation about the axis of an arc of radius r centered on the wall.

23. The mass spectrometer of claim 15 further comprising a grid spanning the narrow opening of the collector cone.

24. The mass spectrometer of claim 15 further comprising means for cooling the sample surface.

25. The mass spectrometer of claim 24 wherein the means for cooling the sample surface includes a coil for circulating a refrigerant.

26. The mass spectrometer of claim 24 wherein the means for cooling the sample surface includes a vessel for containing a cooled liquid.

27. The mass spectrometer of claim 24 wherein the cooling means comprises thermoelectric cooling.

28. The mass spectrometer of claim 15 further comprising at least one sample inlet tube adjacent to the sample surface.

29. The mass spectrometer of claim 15 wherein the detector includes at least one microchannel plate and two anodes with one anode encircling the other.

* * * * *